United States Patent [19]

Carlson

[11] 4,143,595

[45] Mar. 13, 1979

[54] CAN CRUSHER

[76] Inventor: Larry N. Carlson, 6096 Pheasant St., Haslett, Mich. 48840

[21] Appl. No.: 862,754

[22] Filed: Dec. 21, 1977

[51] Int. Cl.[2] ..... B30B 1/04

[52] U.S. Cl. ..... 100/280; 100/DIG. 2

[58] Field of Search ..... 100/DIG. 2, 214, 295, 100/274, 293, 280, 257; 99/572, 573, 579, 583

[56] References Cited

U.S. PATENT DOCUMENTS

| | | | |
|---|---|---|---|
| 136,498 | 3/1873 | Fowler | 100/293 |
| 2,446,898 | 8/1948 | Alvarez | 100/DIG. 2 |
| 4,062,283 | 12/1977 | Kaminski | 100/DIG. 2 |

FOREIGN PATENT DOCUMENTS

| | | | |
|---|---|---|---|
| 76773 | 10/1917 | Switzerland | 100/293 |

*Primary Examiner*—Billy J. Wilhite

*Attorney, Agent, or Firm*—Miller, Morriss and Pappas

[57] ABSTRACT

A can crusher having a plural stage and incremental crushing action which includes a frame with a buttress at one end and plural fulcrum stanchions at the other end. A handle carrying a pivot pin selectively locatable in fulcrum portions of the stanchion is provided and the handle is pivotally linked to a piston for reciprocal extension and retraction in the frame toward and away from the buttress. The primary crushing impact of the piston with a can resting on the buttress in the frame is askew so that the first deformation of the can is not an axial deforming force and the final increment of crushing movement approaches axial thrust.

5 Claims, 6 Drawing Figures

CAN CRUSHER

The present invention is a can crusher having an incremental thrust in plural stepped stages for crushing metal containers such as cans, the containers or cans having a principal axis, a generally cylindrical or tubular body and bottom and top plates. Each stroke of the handle of the present device achieves an incremental advance of a piston in accord with the successive location of the fulcrum of the arm or handle so that the crushing of the can is first the consequence of a slight askew application of compression force and the final stroke at maximum compaction applies a substantially axial compression force. Intermediate strokes approach axial movement. "Axial", in these comments, is referenced to the principal or longitudinal axis of the can or container resting on the buttress in the frame.

OBJECTS OF THE INVENTION

The principal object of the present invention is to provide a can crusher requiring a shorter handle or lever arm by employing incremental advance of the crushing platen or piston and thereby maximizing the application of force in each stroke.

Another object is to provide a can crusher in which each of the plural strokes is accomplished without the application of great manual force so that the housewife is able to achieve easy crushing and the can crusher can be mounted on a firm wall for handy usage and the handle depends in general parallelity to the wall on the outermost fulcrum ready for use.

Still another object is to build a simple can crusher requiring a minimum number of parts and of durable construction.

Other objects, including construction, simplicity and economy will be appreciated as the description proceeds.

For many years, and with each passing year, the people of this world are becoming increasingly conscious of the need for conservation of metal and the need for compacting the metal so that it is in an easy and economic form for transportation and processing. The present can crusher attempts to supply a means for achieving the compaction of metal containers and consequent conservation of the metal in a reasonable and acceptable way by householders and without the use of electric, hydraulic, or pneumatic power in the form of motors or drivers. The present invention is also believed to present a solution to environmental clean-up since the cans and can-like containers for beverages and the like are brought into a recycling form and the recycled metal possesses a market value reachable from the home or kitchen application of manual pressure to the can. The compacted cans can be compactly stored for sale or economic disposition.

THE PRIOR ART

Over the years, many crusher structures have been proposed for compacting cans. Some apply a force transverse to the can axis. Some apply a fracturing action to the can or container in combination with some compaction effort. Other devices apply an axial force to the can or container for achieving compaction. This latter approach is generally followed by the present invention but with a device applying the force in stages or stepped increments and in which the initial crushing is by a force applied askew to the can or container axis so that the force required to initiate the crushing is minimized and the component of thrust assures that the can will be confined in a guideway rather than chancing random buckling outward. The closest prior art known to the inventor is: the U.S. Pat. No. 1,402,433 to Gilbert K. Monroe; the U.S. Pat. No. 3,043,212 to Victor H. Hasselquist; the U.S. Pat. No. 3,009,414 to Karl H. Griemert; and the U.S. Pat. No. 3,941,049 to Russell Britt. None of these devices show or suggest the can crusher presented herein.

In the Drawings

GENERAL DESCRIPTION

Figure 1:
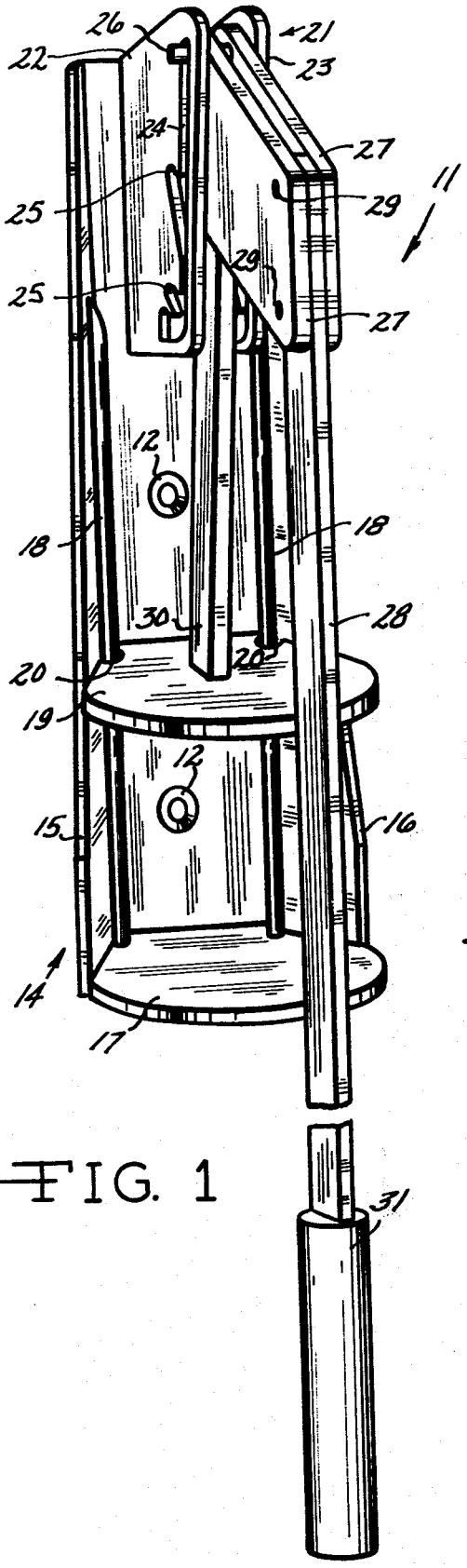
FIG. 1 is a perspective view of the can crusher of the present invention as it would be seen hanging from a kitchen or pantry wall, for example, and ready for the insertion of a can for crushing upon raising the handle.

In general, the present invention comprises a channel-like frame element having longitudinal guide means or rails. At one end of the frame a barrier or buttress is transversely disposed across the channel shaped frame and secured thereto. A stanchion having two spaced-apart walls each with tracks and connecting fulcrum notches or openings is secured to the frame and the tracks and fulcrum notches are in register with each other on each side of an imaginary longitudinal line passed along the frame from the center of the barrier. A handle comprising an elongate lever element and including a principal pivot pin and a piston rod connecting pin is provided. The pivot pin extends into the tracks and notches of the stanchion walls. The connecting pin is pivotally connected to one end of a piston rod. The piston element is connected to the end of the connecting rod opposite the connecting pin and the piston element includes guide slots for guidably moving the piston on the guideways of the frame toward and away from the end barrier, as will be seen. In operation, an empty can, for example a beverage can, is placed with one end resting on the barrier and with the other end upwardly disposed and cradled in the channel of the frame. To achieve the insertion of the can, the handle is rotated upwardly and the pivot pin is lifted in the track of the stanchion element and the pin is rested in the uppermost fulcrum notch. This retracts the piston to allow the insertion of the can since the connecting rod moves with the handle or lever. The upper fulcrum position is most offset from the extended longitudinal center line of the frame. Then the handle is swung downwardly causing the piston to advance toward the uppermost surface of the can and to engage the can in a directional movement askew to the axis of the can and the center line of the frame. This askew engagement applies a side thrust to the can causing the can to initially commence a folding deformation as the stroke of the handle is completed. Then the handle is raised again on the pivot pin and the handle retracts the piston. Then the handle is moved to withdraw the pivot pin from the notch and into the track to the next notch. When the pivot pin is in the next notch, the handle is swung downwardly applying a second force and incrementally compacting the can a second time as the piston reengages the can and applies the levered force from the handle and the second fulcrum. This motion is repeated so that through successive stages the can is pressed and compacted on itself. The thrust at the end stage approaches an axially applied force because the last fulcrum notches are positioned so as to be approximately astraddle of and intersecting the projected can axis where earlier fulcrum notches were above or offset from the projected can axis. When the can is fully compacted, the handle is lifted and the pin is positioned in the top fulcrum notch in preparation for the next use.

Each stroke of the handle is easily accomplished with application of moderate pressure well within the force range of the average housewife and without unusual length in the handle. The device is not unattractive and requires very little intrustion on interior space. It attaches to the walls by screws or bolts through the frame and it is easy to keep clean. The pivot and connecting pins are hardened for wear resistance and in the fulcrum notches and guide tracks the action is smooth and nonbinding.

SPECIFIC DESCRIPTION

In particular and by specific reference to the drawings, a preferred embodiment of the can crusher of the present invention is appreciated. By reference to FIG. 1, the fully assembled can crusher 11 is positioned vertically to be fastened to a wall by passing bolts, screws or other fasteners (not shown) through the openings 12 defined in the web portion 13 of the generally channel shaped frame 14. The flanges 15 and 16 of the channel shaped frame 14 are flared outwardly as shown and extend outwardly more at the lower end (as shown) than from the upper end (as shown). The terms "upper" and "lower" herein are referenced to the FIG. 1 indicating the vertical orientation of the can crusher 11 to a wall. The frame 14 is preferably made of steel bent to the channel shape. At the lower end of the frame 14 a transverse buttress or barrier 17 in the form of a plate secured to the lower edges of the web 13, flanges 15 and 16 as by welding and provides a thrust receiving horizontal platform and spreader upon which, as will be seen, a can or container is positionable. Guide rails 18 flank the inner surfaces of the flanges 15 and 16. The rails 18 are in the form of metal rods welded or otherwise affixed and they extend longitudinally in the frame 14 and are also secured in support relation to the barrier 17. The rails 18 may also be formed integrally in the frame 14 as by a fold, boss or groove to form a directional path along which a piston 19 can move without displacement. While the piston 19 is tiltable on the guides 18, the piston 19 cannot be removed from frame 14 during usage. The piston 19 is a plate, as shown, having the saddle slots 20 which permit a guide following clearance on the guides 18 for achieving a desired tilt of the plate-piston 19 at initial crushing contact with a can or container to be crushed. At the upper end of the frame 14 and at the opposite end from barrier 17 a stanchion element 21 is mounted having wall plates 22 and 23 in spaced parallel relation to each other. As will be appreciated because the frame 14 may be stamped from metal, the walls 22 and 23 forming the uprights of the stanchion 21 may be integral with the frame 14.

The wall plates 22 and 23 of the stanchions have registering tracks 24 and fulcrum notches 25 therein. The tracks 24 and notches 25 are connected so that a pivot pin 26 is selectively positionable in the stanchion 21 and spanning the gap between the two walls 22 and 23 of the stanchion element 21 and in journalled pivotal relation. The stanchion 21 may be a one-piece channel shaped structure or a pair of identical plates fixed or secured as by welding or bolting in place, as shown. The stanchion 21 is metal and may be integrally formed from the stock of frame 14. The pivot pin 26 is attached to the plate extensions 27 to form a clevis-like end of the handle or lever 28. The plate extension 27 of the handle 28 is riveted or otherwise fastened to the handle 28 and may be made integral as by casting or welding. Rivets 29 are shown, in fact.

The handle 28 is also pivotally connected to piston rod 30. The piston rod 30 is secured at its lower end to the piston-plate 19 so that the piston 19 moves with the piston rod 30 in accord with the eccentric throw between the fulcrum position of the handle 28 and the connection of the handle 28 to the piston rod 30. A grip element 31 may be pressed over the outermost extension of the handle-lever 28 for comfort in use and as a buffer to persons passing by the can crusher 11 who might otherwise be injured by chance contact.

Figure 2:
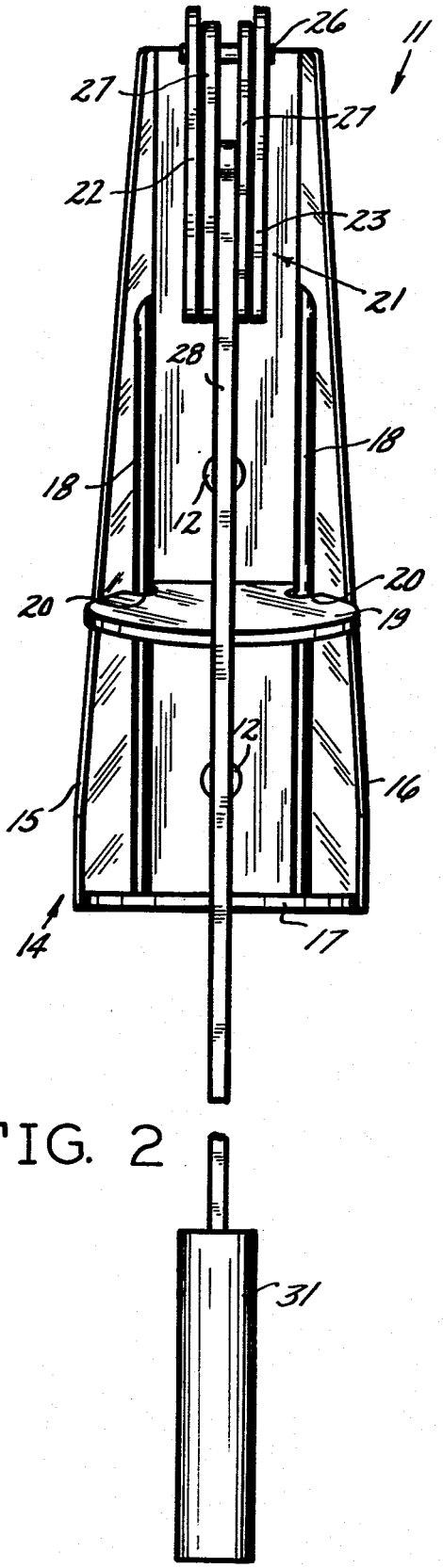
FIG. 2 is a front view of the can crusher of the present invention as shown in FIG. 1.
Figure 3:
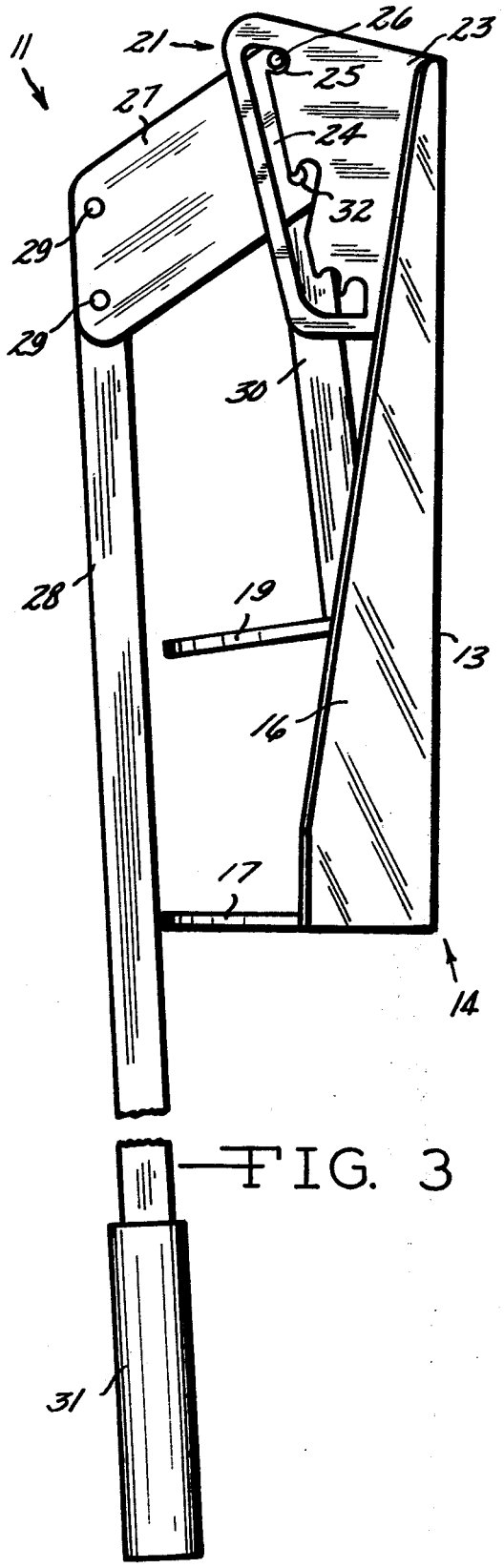
FIG. 3 is a side elevation view of the can crusher as shown in FIG. 2 with the pivot resting in the uppermost or outermost fulcrum slot.

FIG. 2 is a direct frontal view of the unit seen in FIG. 1 and with the handle 28 vertically depending from the fulcrum pin 26. In this view, the piston rod 30 is obscured beneath the handle 28. In the FIG. 3 a connecting pin 32 is visible spanning the clevis-like portion of the handle 28 formed by the plates 27. In the FIG. 4 the guide relationship between the rails 18 and the piston-plate 19 can be best appreciated at the saddle slots 20. The stanchion 21 in the form of the identical spaced-apart walls 22 and 23 is shown welded to the web 13 of the frame 14 and the piston rod 30 is seen as secured to the piston-plate 19 by a weld 33. This assures a secure and nonshifting attachment of the piston 19 to the rod 30.

Figure 5:
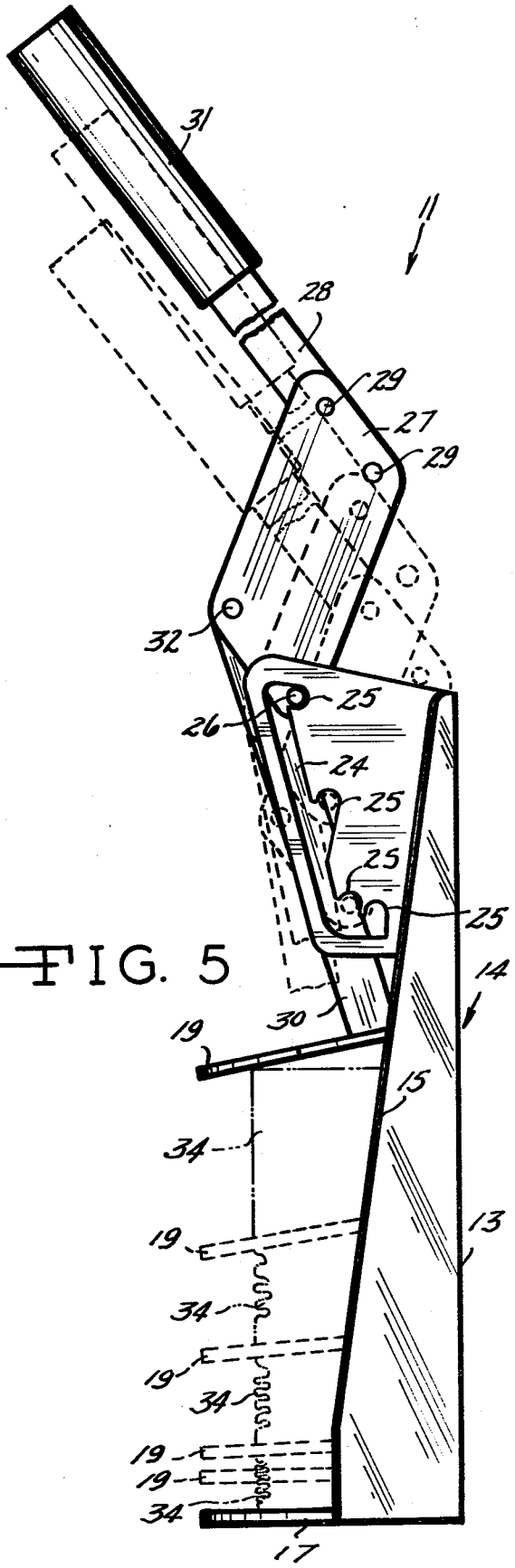
FIG. 5 is a side elevation view of the can crusher shown in the FIG. 1 and showing the elevation of the handle to permit the insertion of a can or container to be crushed and in phantom line indicating the stepwise progression of the crushing commencing with an askew engagement with the can.

In FIG. 5 the operation of the can crusher 11 can be appreciated referencing the function of the can crusher 11 to the can 34 (phantom line) in its initial position on the pedestal formed by the barrier or thrust buttress 17. In general, the can is cradled in frame 14 between the flanges 15 and 16 and the web portion 13 and the path of the piston 19 is generally defined by the guide rails 18 (previously described). Accordingly, the path of the piston 19 generally parallels the longitudinal center line of the frame 14, askew at first, and then in a movement in substantial registry with the axis of the can or longitudinal center line of the frame. Since the can crusher 11 is usually mounted vertically on a wall, the platform made by the barrier element 17 is horizontal and the can 34 is easily rested on the barrier 17, as shown. To achieve this, the handle 28 (depending as shown in FIG. 1) is raised to the position seen in FIG. 5 on the pivot pin 26 resting in the fulcrum notch 25. This action swings the connecting pin 32 upwardly and raises the piston 19 above the top of the can 34. Then the handle 28 is drawn downwardly and the connecting pin 32 and connecting rod 30 are swung downwardly under the leverage of the handle 28. This causes engagement of the piston 19 with the top of the can 34 at a point askew of the axis of the can 34 and applying a component of force urging the contact point of the can 34 downwardly and inwardly toward the web portion 13 of the frame 14. This collapses the outer edge of the can 34 first and as the stroke of the handle 28 is completed, the piston 19 corrogates and depresses the can 34 by the increment of movement achieved by the eccentricity of the fulcrum at pin 26 and the connecting pin 32. The crushing is shown in phantom line. The handle 28 is then elevated and the fulcrum point of pivot pin 26 is moved downwardly to the next lower fulcrum notch 25 in the stanchion 21 and the stroke of handle 28 is repeated causing the descent of the piston 19 onto the partially compressed can and adding another increment of crushing as shown in phantom line. This is successively repeated at intervals dependent upon the location of the fulcrum notches. In the two lowermost notches 25, one is spaced vertically above the other by a relatively short vertical distance so that the displacement of the piston 19 is reduced. This is to assure ease of final compaction in the instance of aluminum or soft metal cans, for example, and steel. It will also be noted that as the piston 19 travels downwardly in its compaction effort, the piston approaches a horizontal disposition and hence the stroke approximates a wholly axial movement. In the earlier strokes, the movement was more askew to the projection of the axis of the can 34 and to achieve a starting infolding of the can 34. As compaction nears completion it is desired that the force applied be wholly in register with the can axis.

Figures 4, 6:
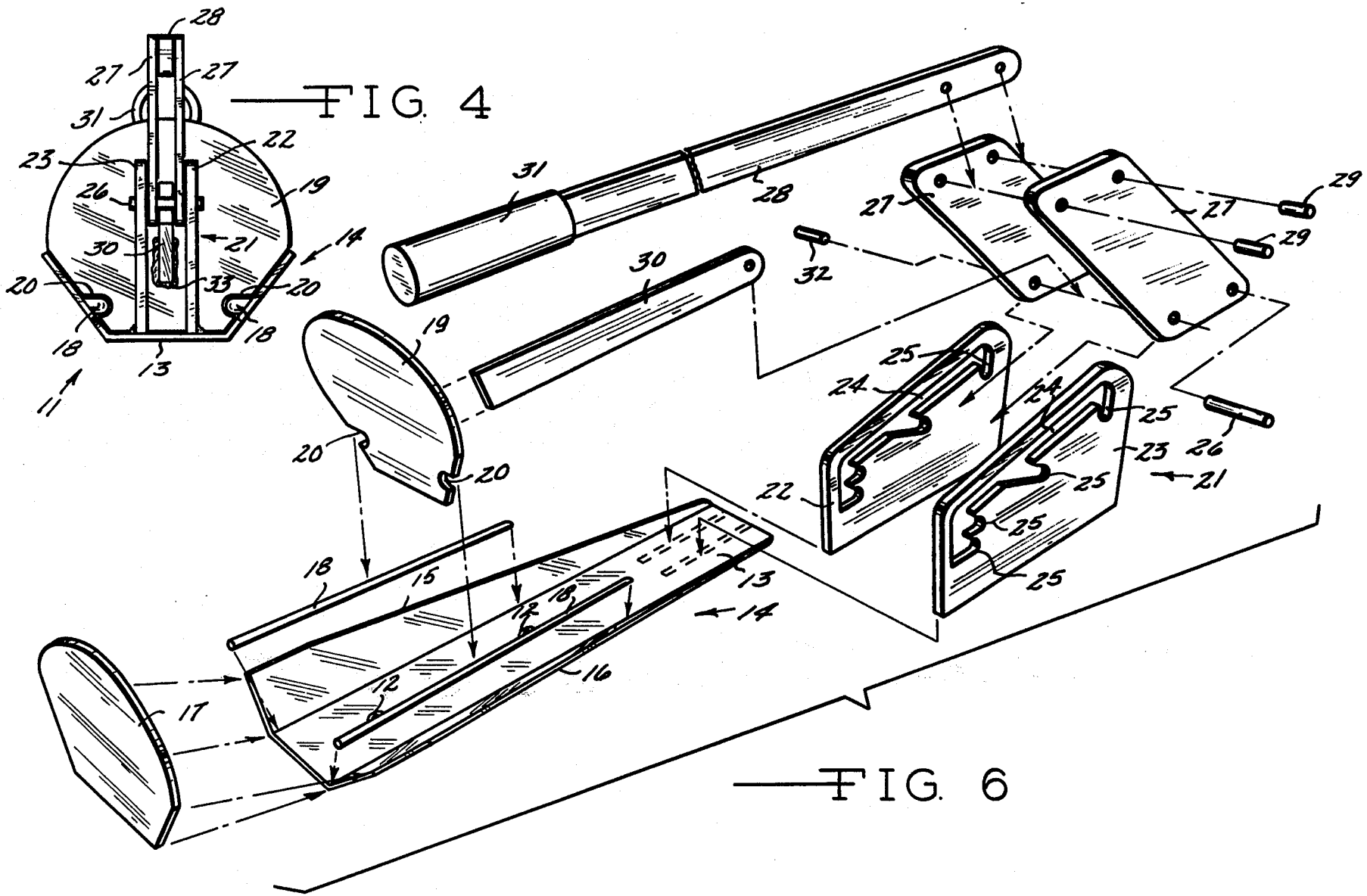
FIG. 4 is an end elevation view taken from the upper or stanchion end of the can crusher seen in FIG. 3.
FIG. 6 is an exploded perspective view of the can crusher of the present invention and indicating the simplicity of the parts and construction techniques employed in the fabrication thereof.

In FIG. 6 the construction and simplicity of the can crusher 11 is best appreciated. The handle 28 is extended by the plate elements 27 secured to the handle 28 by rivets 29 as shown. The pivot pin 26 and the connecting pin 32 are supported by the plates 27 and the connecting pin 32 is pivotally secured to the upper end of the connecting rod 30. The rod 30 is secured on its lower end to the transverse plate or piston 19. The handle 28 and piston 19 with connecting assembly is then placed between the wall elements 22 and 23 of the stanchion 21 and with the pin 26 allowing the handle 28 to be selectively pivoted in any of the fulcrum notches 25 and to move in the connecting track 24. As in the functional FIG. 5, the plural fulcrum locations 25 are in stepped relation. The uppermost fulcrum notch 25 is furthest away from the extension of the longitudinal center line extending from the channel frame 4 and the extension of the axis of can 34. The lowermost fulcrum notches 25 are closest to the longitudinal center line of the frame 14 or the extension of the axis of can 34. This provides an initial piston engagement with the can 34 and following stroke askew to the can axis and the longitudinal center line. The stanchion 21 is then welded or otherwise secured to the base or frame 14 with the piston 19 reciprocable in the channel portion of the frame 14 and guided by the rails 18 in the guide grooves 20 of the piston 19. The barrier 17 is welded or otherwise affixed to the lower end of the channel shaped frame and provides a thrust buttress in support of containers to be crushed.

In operation, manual power operates the structure easily and smoothly. Cans are reduced in size to about one-eighth to one-tenth or less of the total initial volume, dependent on the material of the can and the initial height of the can. By varying the stanchions and the fulcrum intervals, larger of longer cans can be served and the flare of the channel portion of the frame allows the use of the can crusher on various diameter cans as required.

Having thus described my invention and in particular a preferred embodiment thereof, others skilled in the art will readily appreciate changes, improvements, and modifications therein and such changes, improvements and modifications are intended to be a part of my invention limited only by the scope of my hereinafter appended claims.

I claim:

1. A can crusher comprising a channel shaped frame;
a barrier across one end of said frame;
a stanchion element secured to said frame at the end opposite said barrier and having plural fulcrum notches and a guide track therein;
a handle having a pivot pin and a piston connector pin in spaced-apart relation, said pivot pin movable in said guide track and selectively positionable in one of said plural fulcrum notches; and
a piston connected to said handle by said connector pin and reciprocably and guidably movable in said frame in increments established by said fulcrum notches toward and away from said barrier initially at an angle to the plane of said barrier and thereafter approaching plane registry with said barrier.

2. In the can crusher of claim 1 wherein the stanchion element comprises a pair of parallel identical spaced-apart walls having said track and connecting plural fulcrum notches therein and said pivot pin movable in said track and selectively locatable in said fulcrum notches.

3. In the can crusher of claim 1 wherein said connector pin is attached pivotally to said piston by means of an intermediate rod fixedly secured to said piston at one end and pivotally attached to said handle by said connector pin.

4. In the combination of claim 1 wherein said barrier and frame are preassembled and said frame includes can positioning guide rails, wherein said handle, said pivot pin and said connecting pin are preassembled, wherein said stanchion including two spaced-apart parallel tracked and notched walls is secured to said frame in retention of said handle and in positioning of said piston reciprocable on said guide rails in said frame.

5. A can crusher having:
a frame including can positioning guide rails;
a barrier across one end of said frame;
a handle selectively pivotal at plural pivot points on said frame;
a piston eccentrically connected to said handle whereby said piston upon movement of said handle is moved toward and away from said barrier and said pivot points initially positioned to move said piston in an askew relation with said barrier and said pivot points successively reducing the askew relation with said barrier.

* * * * *

UNITED STATES PATENT OFFICE

CERTIFICATE OF CORRECTION

Patent No. 4,143,595 Dated March 13, 1979

Inventor(s) Larry N. Carlson

It is certified that error appears in the above-identified patent and that said Letters Patent are hereby corrected as shown below:

Column 3, line 25, change "intrustion" to read --- intrusion ---

Column 5, line 47, change "4" to read --- 14 ---

Column 6, line 4, change "of" to read --- or ---

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*